US011120747B2

(12) United States Patent
Aflatooni et al.

(10) Patent No.: US 11,120,747 B2
(45) **Date of Patent: *Sep. 14, 2021**

(54) DATA SIGNAL ADJUSTMENT FOR DISPLAYS

(71) Applicant: Apple Inc., Cupertino, CA (US)

(72) Inventors: Koorosh Aflatooni, Los Altos Hills, CA (US); Warren S. Rieutort-Louis, Cupertino, CA (US); Jean-Pierre S. Guillou, Los Gatos, CA (US); Pierre-Yves Emelie, Mountain View, CA (US); Myung-Je Cho, San Jose, CA (US); Marc Albrecht, San Francisco, CA (US); Graeme M. Williams, Cupertino, CA (US); Sean C. Chang, Mountain View, CA (US); Zhao Wang, Redwood City, CA (US)

(73) Assignee: Apple Inc., Cupertino, CA (US)

( * ) Notice: Subject to any disclaimer, the term of this patent is extended or adjusted under 35 U.S.C. 154(b) by 15 days.

This patent is subject to a terminal disclaimer.

(21) Appl. No.: 16/802,756

(22) Filed: Feb. 27, 2020

(65) Prior Publication Data

US 2020/0202791 A1 Jun. 25, 2020

Related U.S. Application Data

(63) Continuation of application No. 15/989,066, filed on May 24, 2018, now Pat. No. 10,607,549.

(Continued)

(51) Int. Cl.
*G09G 3/3275* (2016.01)

(52) U.S. Cl.
CPC ..... *G09G 3/3275* (2013.01); *G09G 2300/04* (2013.01); *G09G 2310/0232* (2013.01);

(Continued)

(58) Field of Classification Search
None
See application file for complete search history.

(56) References Cited

U.S. PATENT DOCUMENTS 6,914,602 B2 7/2005 Kaskel
7,623,140 B1 11/2009 Yeh et al.

(Continued)

FOREIGN PATENT DOCUMENTS

CN 1881060 A 12/2006
CN 103365354 A 10/2013

(Continued)

*Primary Examiner* — Christopher R Lamb
(74) *Attorney, Agent, or Firm* — Treyz Law Group, P.C.; Jason Tsai

(57) ABSTRACT

A display may have an active area that includes display pixels. The display may include an inactive notch region that extends into the active area. Data lines may provide image data from display driver circuitry to the display pixels. The image data may include data signals that correspond to portions of the display that do not include pixels, such as the inactive notch region. The null data signals may cause nonuniformities in the displayed image. The null data signals may be adjusted to minimize the nonuniformities. Null data signals corresponding to the inactive notch region may be adjusted to have gray levels that gradually decrease with distance from the border between the inactive notch and the active area. All of the data signals corresponding to the inactive notch may be set to a uniform gray level.

20 Claims, 6 Drawing Sheets

Related U.S. Application Data

(60) Provisional application No. 62/553,745, filed on Sep. 1, 2017.

(52) U.S. Cl.
CPC ..... *G09G 2320/0209* (2013.01); *G09G 2320/0223* (2013.01); *G09G 2320/0233* (2013.01); *G09G 2320/0285* (2013.01); *G09G 2320/0666* (2013.01); *G09G 2320/0686* (2013.01)

(56) References Cited

U.S. PATENT DOCUMENTS

| | | | | |
|---|---|---|---|---|
| 8,933,916 | B1 | 1/2015 | Doar et al. | |
| 10,607,549 | B2 * | 3/2020 | Aflatooni | G09G 3/3275 |
| 2007/0290964 | A1 | 12/2007 | Yang | |
| 2009/0102824 | A1 | 4/2009 | Tanaka et al. | |
| 2010/0134401 | A1 | 6/2010 | Shin et al. | |
| 2013/0328051 | A1 | 12/2013 | Franklin et al. | |
| 2014/0197428 | A1 | 7/2014 | Wang et al. | |
| 2016/0155395 | A1 | 6/2016 | Park et al. | |
| 2016/0351094 | A1 * | 12/2016 | Chaji | G09G 5/026 |
| 2017/0123575 | A1 | 5/2017 | Evans, V et al. | |
| 2017/0193963 | A1 | 7/2017 | Pan et al. | |
| 2017/0206852 | A1 | 7/2017 | Liu et al. | |
| 2017/0249906 | A1 | 8/2017 | Noh et al. | |
| 2018/0075797 | A1 | 3/2018 | Park et al. | |
| 2018/0113241 | A1 | 4/2018 | Powell et al. | |

FOREIGN PATENT DOCUMENTS

| | | | |
|---|---|---|---|
| CN | 103915475 | A | 7/2014 |
| CN | 104835467 | A | 8/2015 |
| CN | 105164743 | A | 12/2015 |
| CN | 105487313 | A | 4/2016 |
| CN | 106843389 | A | 6/2017 |
| KR | 10-2016-066642 | A | 6/2016 |
| KR | 10-2016-081793 | A | 7/2016 |
| WO | 2014142183 | A1 | 9/2014 |
| WO | 2017058416 | A1 | 4/2017 |

* cited by examiner

DATA SIGNAL ADJUSTMENT FOR DISPLAYS

This application is a continuation of application Ser. No. 15/989,066, filed May 24, 2018, which claims the benefit of provisional patent application No. 62/553,745, filed Sep. 1, 2017, which are hereby incorporated by reference herein in their entireties.

BACKGROUND

This relates generally to electronic devices, and more particularly, to electronic devices with displays.

Electronic devices often include displays. For example, cellular telephones and portable computers often include displays for presenting information to a user.

Displays contain arrays of pixels for presenting images to a user. The active area may be rectangular and may be bordered by an inactive area that does not include pixels. Data lines provide data signals from a display driver integrated circuit mounted outside of the active area to the pixels in the array.

Difficulties may arise in attempting to display images on displays that do not have uniformly rectangular shapes (e.g., displays having rounded corners and/or inactive areas that extend into the active area to form an inactive notch). For example, data lines may be provided with data signals corresponding to pixels that would exist in a uniformly rectangular display, but that do not exist due to the presence of rounded corner portions or a notch-shaped inactive area. These data signals may be adjusted so that the image can be displayed. If care is not taken, however, adjusting the display data signals may cause undesirable visual artifacts on the display.

SUMMARY

A display may have an active area that includes display pixels. The display may include an inactive notch region that extends into the active area of the display to accommodate a speaker or other components. Data lines may provide data signals from display driver circuitry to the display pixels. Gate lines may control loading of the data signals into the display pixels.

When displaying data for a rectangular image, the data lines may be provided with data signals corresponding to pixels that would exist in a uniformly rectangular display, but that do not exist due to the presence of the inactive notch region. These data signals for nonexistent pixels (null data signals) may cause nonuniformities in a displayed image. The null data signals can be adjusted to minimize the nonuniformities (e.g., smooth the edge between the active area and the inactive notch region), but these adjustments may create abrupt transitions in the voltages that are provided on the data lines. These abrupt transitions may lead to undesirable display artifacts.

Data signal compensation operations may be used to gradually transition the voltages on the data lines. Null data signals corresponding to the inactive notch region may be highest closer to the border between the active area and the inactive notch, and decrease to zero farther from the border. All of the data signals corresponding to a portion of the display in which there are no actual pixels may be set to a uniform gray level.

DETAILED DESCRIPTION

Figure 1:
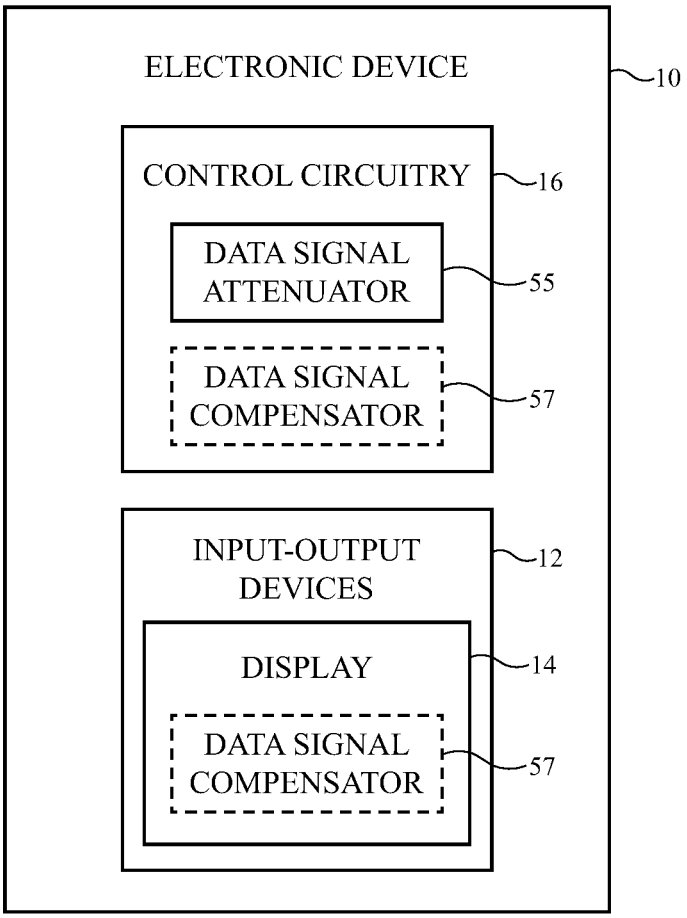
FIG. 1 is a diagram of an illustrative electronic device having a display in accordance with an embodiment.

An illustrative electronic device of the type that may be provided with a display is shown in FIG. 1. Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a display, a computer display that contains an embedded computer, a computer display that does not contain an embedded computer, a gaming device, a navigation device, an embedded system such as a system in which electronic equipment with a display is mounted in a kiosk or automobile, or other electronic equipment.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light emitting diodes and other status indicators, data ports, proximity sensors, ambient light sensors, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user. A touch sensor for display 14 may be based on an array of capacitive touch sensor electrodes, acoustic touch sensor structures, resistive touch components, force-based touch sensor structures, a light-based touch sensor, or other suitable touch sensor arrangements. A touch sensor for display 14 may be formed from electrodes formed on a common display substrate with the pixels of display 14 or may be formed from a separate touch sensor panel that overlaps the pixels of display 14. If desired, display 14 may be insensitive to touch (i.e., the touch sensor may be omitted).

Control circuitry 16 may be used to run software on device 10 such as operating system code and applications. During operation of device 10, the software running on control circuitry 16 may display images on display 14. If desired, control circuitry 16 may include a data signal attenuator 55 for attenuating image data signals provided to display 14. In one illustrative example, control circuitry 16 may also include a data signal compensator 57 for adjusting data signals that have been attenuated by attenuator 55. In another illustrative example, data signal compensator 57 may be incorporated into display 14, where it may receive and adjust data signals that have been attenuated by attenuator 55.

Figure 2:
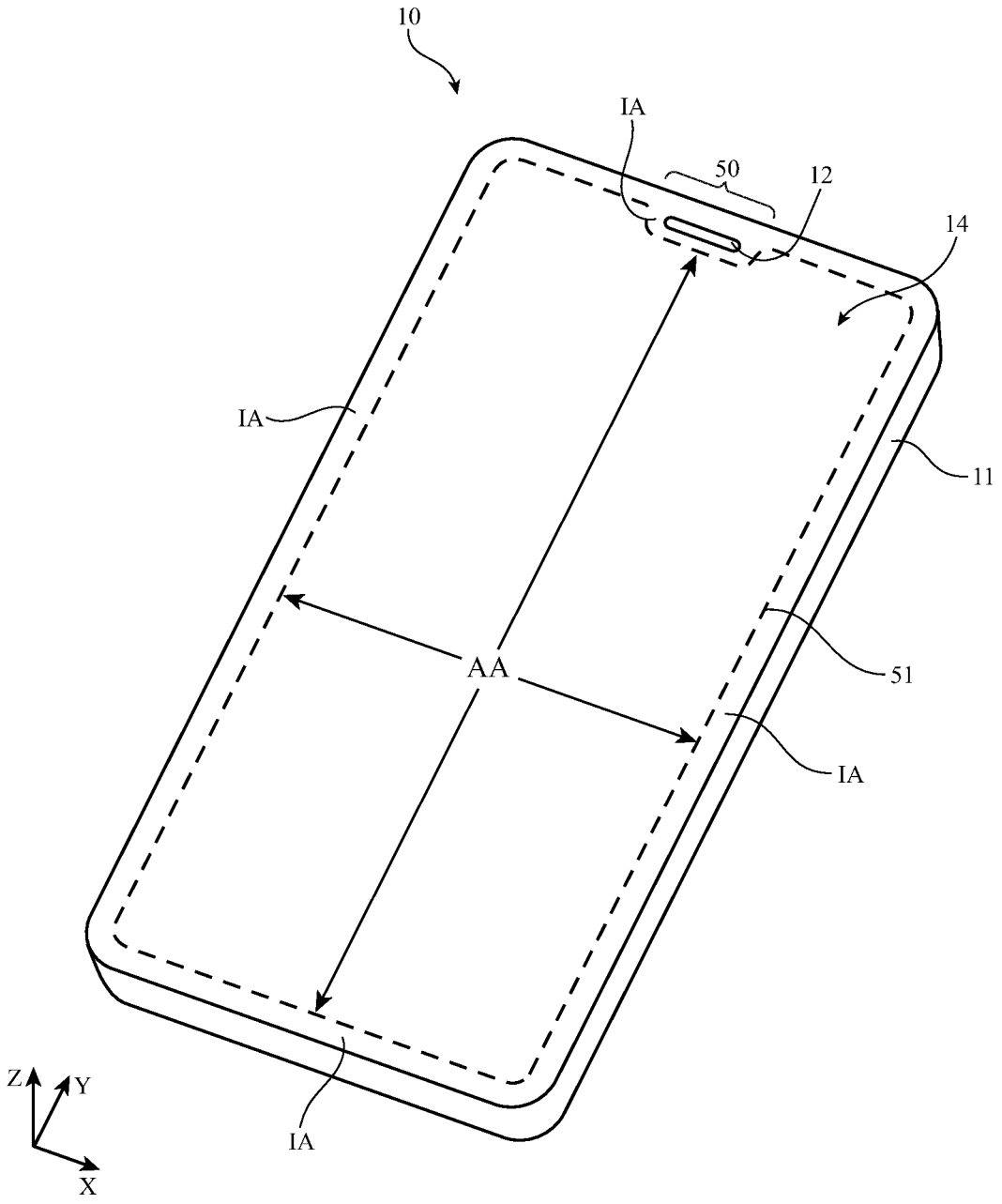
FIG. 2 is a perspective view of an illustrative electronic device having a display with an active area and an inactive area in accordance with an embodiment.

A perspective view of an illustrative electronic device 10 is shown in FIG. 2. Device 10 may have a housing 11 in which components such as input-output devices 12, display 14, and control circuitry 16 are mounted. Housing 11, which may sometimes be referred to as an enclosure or case, may be formed of plastic, glass, ceramics, fiber composites, metal (e.g., stainless steel, aluminum, titanium, gold, etc.), other suitable materials, or a combination of any two or more of these materials. Housing 11 may be formed using a unibody configuration in which some or all of housing 11 is machined or molded as a single structure or may be formed using multiple structures (e.g., an internal frame structure, one or more structures that form exterior housing surfaces, etc.).

As shown in FIG. 2, display 14 may have an active area AA and an inactive area IA that together take up most or all of the front face of device 10. Active area AA may include pixels that emit light to display images for a user. Inactive border area IA may surround active area AA and be used to accommodate display driver circuitry, gate driver circuitry, power supply circuitry, and conductive paths for providing display signals to the pixels in the active area. Inactive area IA may be free of display pixels. Active area AA and inactive area IA may meet at a border 51 (sometimes referred to herein as the active area border, inactive area border, boundary, or dividing line between the active area and the inactive area) In order to accommodate input-output components 12 such as a speaker, camera, ambient light sensor, or proximity sensor in device 10, a portion of inactive area IA may extend into active area AA to form a notch 50 (sometimes referred to herein as a notched region, inactive notch, or notch-shaped recess). The shape of border 51 between the active area and the inactive area may have bent portions (sometimes referred to herein as curved portions, deflected portions, meandering portions, or serpentine portions) where notch 50 extends into the active area. As shown in FIG. 2, the border 51 may have rounded corners. Since inactive area IA is free of display pixels, input-output components may be mounted in the notched area 50 without being obstructed by the active display structures.

Display 14 may be an organic light-emitting diode display. In an organic light-emitting diode display, each pixel contains a respective organic light-emitting diode. A positive power supply voltage ELVDD may be supplied to a positive power supply terminal of the organic light-emitting diode and a ground power supply voltage ELVSS may be supplied to ground power supply terminal of the organic light emitting diode. The diode has an anode (terminal AN) and a cathode (terminal CD). The state of a drive transistor controls the amount of current flowing through the diode and therefore the amount of emitted light from the display pixel. The cathode is coupled to the ground terminal, so the cathode terminal of the diode may sometimes be referred to as the ground terminal.

Figure 3:
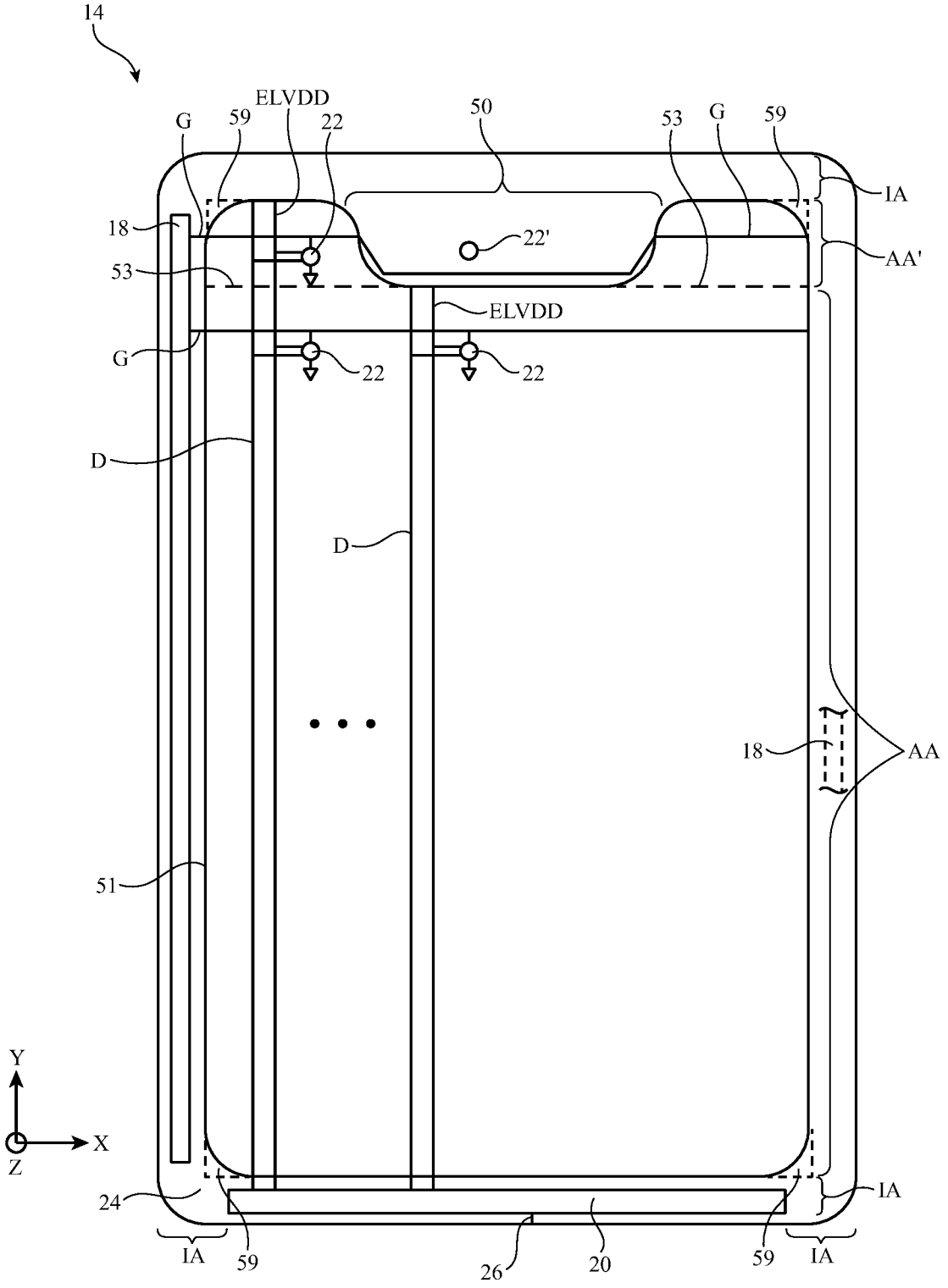
FIG. 3 is a diagram of an illustrative organic light-emitting diode display in accordance with an embodiment.

As shown in FIG. 3, display 14 may include layers such as substrate layer 24. Substrate 24 and, if desired, other layers in display 14, may be formed from layers of material such as glass layers, polymer layers (e.g., flexible sheets of polyimide or other flexible polymers), etc. Substrate 24 may be planar and/or may have one or more curved portions. Substrate 24 may have a rectangular shape with left and right vertical edges that extend along the Y-axis and upper and lower horizontal edges that extend along the X-axis, or may have a non-rectangular shape. In configurations in which substrate 24 has a rectangular shape with four corners, the corners may, if desired, be rounded.

Display 14 may have an array of image pixels 22 arranged in rows and columns. Pixels 22 form an active area AA of display 14 that displays images for a user. Inactive border portions of display 14 such as inactive areas IA along one or more of the edges of substrate 24 do not contain pixels 22 and do not display images for the user (i.e., inactive area IA is free of pixels 22).

Each pixel 22 (sometimes referred to herein as light-emitting pixels 22) may have a light-emitting diode such as organic light-emitting diode and associated thin-film transistor circuitry. The array of pixels 22 may be formed from rows and columns of pixel structures (e.g., pixels formed from structures on display layers such as substrate 24). There may be any suitable number of rows and columns in the array of pixels 22 (e.g., ten or more, one hundred or more, or one thousand or more). Display 14 may include pixels 22 of different colors. As an example, display 14 may include red pixels that emit red light, green pixels that emit green light, and blue pixels that emit blue light. Configurations for display 14 that include pixels of other colors may be used, if desired. The use of a pixel arrangement with red, green, and blue pixels is merely illustrative.

Display driver circuitry 20 for display 14 may be mounted on a printed circuit board that is coupled to substrate 24 or may be mounted on substrate 24. Signal paths such as signal path 26 may couple display driver circuitry 20 to control circuitry 16. Circuitry 20 may include one or more display driver integrated circuits and/or thin-film transistor circuitry.

During operation, the control circuitry of device 10 (e.g., control circuitry 16 of FIG. 1) may supply circuitry such as display driver circuitry 20 with information on images (e.g., frames of image data) to be displayed on display 14. To display the images on display pixels 22, display driver circuitry 20 may supply corresponding image data to data lines D while issuing clock signals and other control signals to supporting display driver circuitry such as gate driver circuitry 18. Data lines D are associated with respective columns of pixels 22. Gate driver circuitry 18 may produce gate line signals (sometimes referred to as scan signals, emission enable signals, etc.) or other control signals for pixels 22. The gate line signals may be conveyed to pixels 22 using lines such as gate lines G. There may be one or more gate lines per row of pixels 22. Gate driver circuitry 18 may include integrated circuits and/or thin-film transistor circuitry and may be located along the edges of display 14 (e.g., along the left and/or right edges of display 14 as shown in FIG. 3) or elsewhere in display 14 (e.g., as part of circuitry 20, along the lower edge of display 14, etc.). The configuration of FIG. 3 is merely illustrative.

Gate driver circuitry 18 may assert gate line signals on the gate lines G in display 14. For example, gate driver circuitry 18 may receive clock signals and other control signals from display driver circuitry 20 and may, in response to the received signals, assert a gate signal on gate lines G in sequence, starting with the gate line signal G in the first row of display pixels 22. As each gate line is asserted, data from data lines D is loaded into the corresponding row of display pixels. In this way, control circuitry in device 10 such as display driver circuitry 20 may provide pixels 22 with signals that direct pixels 22 to generate light for displaying a desired image on display 14.

The circuitry of pixels 22 and, if desired, display driver circuitry such as circuitry 18 and/or 20 may be formed using thin-film transistor circuitry. Thin-film transistors in display 14 may, in general, be formed using any suitable type of thin-film transistor technology (e.g., silicon transistors such as polysilicon thin-film transistors, semiconducting-oxide transistors such as indium gallium zinc oxide transistors, etc.).

Conductive paths (e.g., one or more signal lines, blanket conductive films, and other patterned conductive structures) may be provided in display 14 to route data signals D, gate signals G, and power signals such as positive power supply signal ELVDD to pixels 22. As shown in FIG. 3, these signals may be provided to pixels 22 in active area AA using signal routing paths that receive signals D, gate lines G, and ELVDD.

As shown in FIG. 3, notch 50 may protrude into the active area AA of display 14. While notch 50 is free of display pixels 22, the portions of the active area AA adjacent to the notch (e.g., active area portions AA' on the left and right sides of notch 50) may include display pixels 22. In order to provide gate signals from gate driver circuitry 18 to the pixels 22 on both sides of notch 50, gate lines G may have bent portions (sometimes referred to herein as curved portions, serpentine portions, meandering portions, or deflected portions) that are routed around notch 50. Although there are no pixels 22 in notch 50 to which these gate lines G provide gate signals, notch 50 may include other circuitry such as dummy pixels or capacitor structures that are coupled to these gate lines. Dummy pixel structures and/or capacitor structures may help prevent undesirable display artifacts that can arise due to the fact that gate lines G that are routed through notch 50 (e.g., gate lines that provide gate signals to pixels in active area region AA') are coupled to different numbers of display pixels 22 than gate lines G formed in the rest of active area AA.

A display of the type shown in FIG. 3 may, as an example, include approximately 2,500 rows of display pixels 22 and 1,250 columns of display pixels 22. In the illustrative arrangement of FIG. 3, such a display 14 would have 2,500 gate lines G and 1,250 data lines D. As shown in FIG. 3, the data lines D that run along the left and right edges of the display may provide data signals to a pixel in each of the rows of the display, including pixels that are formed in active area portions AA' on either side of notch 50. Due to the presence of notch 50, however, some data lines D that run through the center of the display may provide data signals to less than each row of the display (i.e., data lines D that are under notch 50 may run into notch 50 and terminate earlier than data lines that provide data signals to pixels in active area region AA'). In one example, notch 50 may have a height in the Y-direction of approximately 100 rows of pixels. In such an arrangement, data lines D that run into notch 50 may be coupled to approximately 100 fewer display pixels 22 than data lines that extend across the entire height of the display (e.g., data lines that extend through active area region AA' and into the edge of the active area in region AA').

Because gate lines G control the loading of data signals (data loading) from the data lines D into the pixels 22, the presence of notch 50 may result in an arrangement in which a first set of gate lines that extend edge-to-edge across the active area of the display in the X direction (e.g., gate lines that do not run into notch 50 and are not in active area portion AA') to control data loading for both a first set of data lines and a second set of data lines. The first set of data lines may extend across the display in the Y direction to the edge of the active area adjacent to the notch in active area portion AA' (e.g., data lines that do not run into notch 50). The second set of data lines may extend across the display and terminate at the notch. A second set of gate lines that do extend through active area portion AA' and that run into notch 50 may control data loading for the first set of data lines that are present adjacent to the notch in active area portion AA', but not for the second set of data lines that extend across the display and terminate at the notch. The first and second sets of gate lines may each include any suitable numbers of gate lines (e.g., three, five, ten, one hundred, five hundred, or other suitable numbers of gate lines). The first and second sets of data lines may each include any suitable numbers of data lines (e.g., three, five, ten, one hundred, five hundred, or other suitable numbers of data lines).

Despite the fact that there are no actual image pixels 22 in notch 50, data lines that provide data signals to the columns of pixels that terminate at notch 50 may still generate data signals as if there were pixels in notch 50. For example, these data lines may still be toggled between different data voltages for every row of pixels as the gate lines load a frame of data into the display. Since there are no display pixels in notch 50, however, these data signals are not actually received by any display pixels 22 and are simply replaced with a new data signal on data line D when the next row of pixels is programmed. These data signals may be referred to as data signals for virtual pixels 22' (because the data signals correspond to pixels that do not actually exist), inactive data (because the data corresponds to the inactive notch area of the display), non-image data (because the data signals do not correspond to any image content displayed in the active area), null data signals (because even though the data signals may have a value greater than zero, they are not being used to drive pixels in the active area), constant or constant value data (because the data that is driven onto the data lines D corresponding to the inactive notch may not change between frames), dummy data signals, filler data signals, or notch data signals. Once programming for the frame has reached a row that does include display pixels coupled to the data lines D that terminate early (i.e., the data lines that run into notch 50), the data signals on these data lines D will be provided to a display pixel 22.

Null data/non-image data may correspond to data signals that, if provided to a pixel, would cause the pixel to emit no light (e.g., the pixel would remain off and would appear black). In this way, null data/non-image data may have the minimum data signal voltage level (e.g., 0 volts) and correspond to a gray level of 0, and may be referred to as black data. Null data/non-image data may correspond to data signals that, if provided to a pixel, would cause the pixel to emit some light while remaining below the pixel's maximum luminance. In this way, null data/non-image data may have a data signal voltage level higher than the minimum and correspond to a gray level of 1 or greater, and may be referred to as gray data.

In arrangements in which the active area AA of display 14 has rounded corners as shown in FIG. 3, the inactive area may include corner regions 59 (sometimes referred to herein as inactive corners) that would include display pixels if not for the rounded corners of the active area AA (e.g., if active area AA had a completely rectangular shape). Corner regions 59 may cause the premature termination of data lines D that run into corner regions 59. In this type of arrangement, at least some of the data signals on these data lines are actually for virtual pixels 22' that correspond to locations in the corner regions 59.

In organic light-emitting diode displays, colored emissive material may be used to provide the light-emitting diodes with the ability to emit red, green, and blue light (or light of other colors). For example, red organic light-emitting diodes may contain red organic emissive material, green organic light-emitting diodes may contain green organic emissive material, and blue organic light-emitting diodes may contain blue organic emissive material. The emissive material may degrade as the light-emitting diodes are used. Heavy use, in which diodes are driven with large currents, may age the diodes more rapidly than light use, in which the diodes are driven with small currents. As the diodes age, the degraded emissive material will cause the diodes to emit a reduced amount of light for a given drive current. Pixel luminance in organic light-emitting diode displays is therefore generally a function of the aging history of the pixels in the display. Pixel luminance and aging may be monitored based on the data signals that are provided to the pixels. For example, a pixel that is provided with data signals that cause the pixel to be driven at a high luminance level using large currents will degrade more quickly than if the same pixel were provided with data signals that cause the pixel to be driven at a low luminance level using low currents. Because data signals sent out on data lines D generally correspond to a gray value between 0 and 255 (i.e., the larger the value of the data signal/gray value, the more brightly the pixel is driven), circuitry in electronic device 10 may be able to track the aging of the pixels of the display based on these data signals as they are provided on data lines D.

To compensate for these undesired aging-induced changes in display pixels 22 and therefore ensure that display 14 can display images accurately, device 10 may be provided with pixel luminance degradation compensation capabilities (sometimes referred to herein as burn-in compensation). In particular, the control circuitry of device 10 may be used to implement a pixel luminance degradation tracker and/or pixel luminance degradation compensator that maintains information on the aging history of each of the pixels (sometimes referred to herein as burn-in statistics) in display 14. Based on this aging information, the pixel luminance degradation compensator can adjust the luminance values supplied to each of the pixels in display 14. As the luminance of pixels that have degraded due to aging decreases over time, the data signals (sometimes referred to herein as pixel luminance values or gray values) provided to other pixels in the display may be altered (e.g., reduced) so that the overall luminance of the display matches the reduced luminance of the pixels that have aged more quickly.

As described above in connection with FIG. 3, display driver 20 may send out inactive data signals for pixels that would be present (but are not actually present) if not for the presence of notch 50. Because display aging is monitored based on the data signals sent out on data lines D (whether or not they are actually received by any pixels 22), however, these inactive data signals that are being provided for virtual pixels 22' (e.g., in notch 50 or corner regions 59) may cause inaccuracies in pixel luminance degradation tracking. For example, if display driver 20 is sending inactive data signals corresponding to high luminance values, but no pixels are actually receiving these data signals or displaying bright content because the data signals are for virtual pixels 22', pixel luminance degradation tracking may nonetheless take these inactive data signals into account when determining pixel aging. When the pixel luminance degradation compensator compensates (reduces) the brightness of the display based on pixel aging information for pixels that do not actually exist, display 14 may be dimmed inaccurately or prematurely.

In order to prevent the pixel luminance degradation compensator from reducing the brightness of the display based on pixel aging information for pixels that do not actually exist, electronic device 10 may implement data signal attenuation (sometimes referred to herein as data signal reduction, data signal minimization, adaptive border gain, or edge filtering) that adjusts the values of the inactive data signals that are being provided for virtual pixels 22' (e.g., in notch 50 or corner regions 59) before these data signals are distributed on data lines D. For example, data signal attenuation may be implemented in control circuitry 16 such that the values of the inactive data signals for virtual pixels 22' are adjusted to zero (i.e., minimum luminance or black pixel data) before being provided to display driver circuitry 20 or distributed on data lines D. Since these data signals are adjusted to 0, their effect on pixel luminance degradation tracking can be reduced or eliminated, thereby preventing the pixel luminance degradation compensator from reducing the brightness of the display based on pixel aging information for pixels that do not actually exist. Data signal attenuation may not adjust data signals for display pixels 22 in the active area AA of the display, so these data signals will be distributed normally on data lines D.

If desired, adaptive border gain operations (data signal attenuation) of the type described above may also be used to provide a smooth visual transition between the active area AA and the inactive area IA in the region around notch 50. For example, when the border 51 has curved portions as shown in FIG. 3, adaptive border gain operations may adjust the data signals provided to pixels 22 near the curved portions of border 51. Adjusting some of the data signals provided to the display pixels 22 in active area AA may help to avoid abrupt brightness transitions that can create visible jagged edges along border 51.

If desired, data signal attenuation operations may be performed using circuitry in control circuitry 16 and/or display driver circuitry 20. In another example, electronic device 10 may include hardware structures such as a data signal attenuator (sometimes referred to herein as data signal attenuation circuitry, a data signal minimizer, a data signal reducer, an edge filter engine, or an adaptive border gain mechanism) that performs data signal attenuation operations. If desired, data signal attenuator 55 may be formed in control circuitry 16, in display driver 20, or from other circuitry in device 10.

As described above in connection with FIG. 3, each pixel 22 may receive a positive power supply voltage ELVDD on a positive power supply voltage line (e.g., a positive power supply voltage mesh) and data signals on data lines D. Due to the arrangement of the data lines D and the positive power supply voltage lines in the display panel 14, there may be capacitive coupling between the data lines D and the positive power supply voltage line during normal operation of display 14. Data lines D that extend beneath notch 50 may be driven with a data signal (sometimes referred to herein as a gray level) of 0 for the programming of approximately the first 100 rows of the display (i.e., the inactive notch) when data signal attenuation is implemented. Once programming begins for a row of the display that includes display pixels 22 to which these data lines D provide data signals, however, the data signal attenuation will no longer be applied and these data lines D will be provided with normal data signals. In some scenarios, this can lead to a large change in the data signal that is provided on a data line D. For example, a data line D beneath notch region 50 may transition from providing a gray value of 0 for the first 100 rows to a gray value of approximately 225 at row 101. This sudden change in the voltage on data line D can alter the capacitive coupling (sometimes referred to herein as horizontal cross-talk) between the data line D and the positive power supply voltage line, causing a voltage drop on the positive power supply voltage line in the vicinity of the row at which the transition takes place (e.g., in one or more of rows 90-110 of display 14). Because the amount of current passing through the organic light-emitting diode in each pixel 22 is based on the positive power supply voltage, this voltage drop on the positive power supply voltage line may cause the current passing through the organic light-emitting diodes in the vicinity of row 100 to also drop. This drop in the current passing through the organic light-emitting diodes can cause a resultant drop in the brightness of these pixels, causing a dim, horizontal line to appear on the display in the vicinity of row 100. If care is not taken, this dim line may be visible to a user of electronic device 10, creating an undesirable display artifact.

To reduce or eliminate the dim line at the border between the central active area AA and the portion of the active area AA' adjacent to notch 50 without causing premature display dimming due to pixel luminance degradation compensation, the null data signals that are provided for virtual pixels 22' (e.g., in notch 50 or corner regions 59) may be adjusted to a value that eases the data signal value transition at the active area beneath notch 50 or near corner regions 59. Operations that adjust the data signals to ease this transition may be referred to herein as data signal compensation, data signal correction, data signal adjustment, or data signal masking. In one example, data signal compensation operations may be performed using circuitry in control circuitry 16 and/or display driver circuitry 20. In another example, electronic device 10 may include hardware structures such as a data signal compensator 57 (sometimes referred to herein as data signal compensation circuitry or a data signal nullifier) that performs data signal compensation operations. If desired, data signal compensator 57 may be formed in control circuitry 16, in display driver 20, or using other circuitry in device 10. Data signal compensation operations may be performed using a mathematical mask that is applied to the null data signals, using a look-up table that relates specific pixel addresses (e.g., the specific row and column in which a pixel is located) with respective compensated inactive data signals or inactive data signal compensation factors (e.g., gain values), using a look-up table that relates specific pre-compensation data signals to compensated inactive data signal values, or using other operations.

Figure 4:
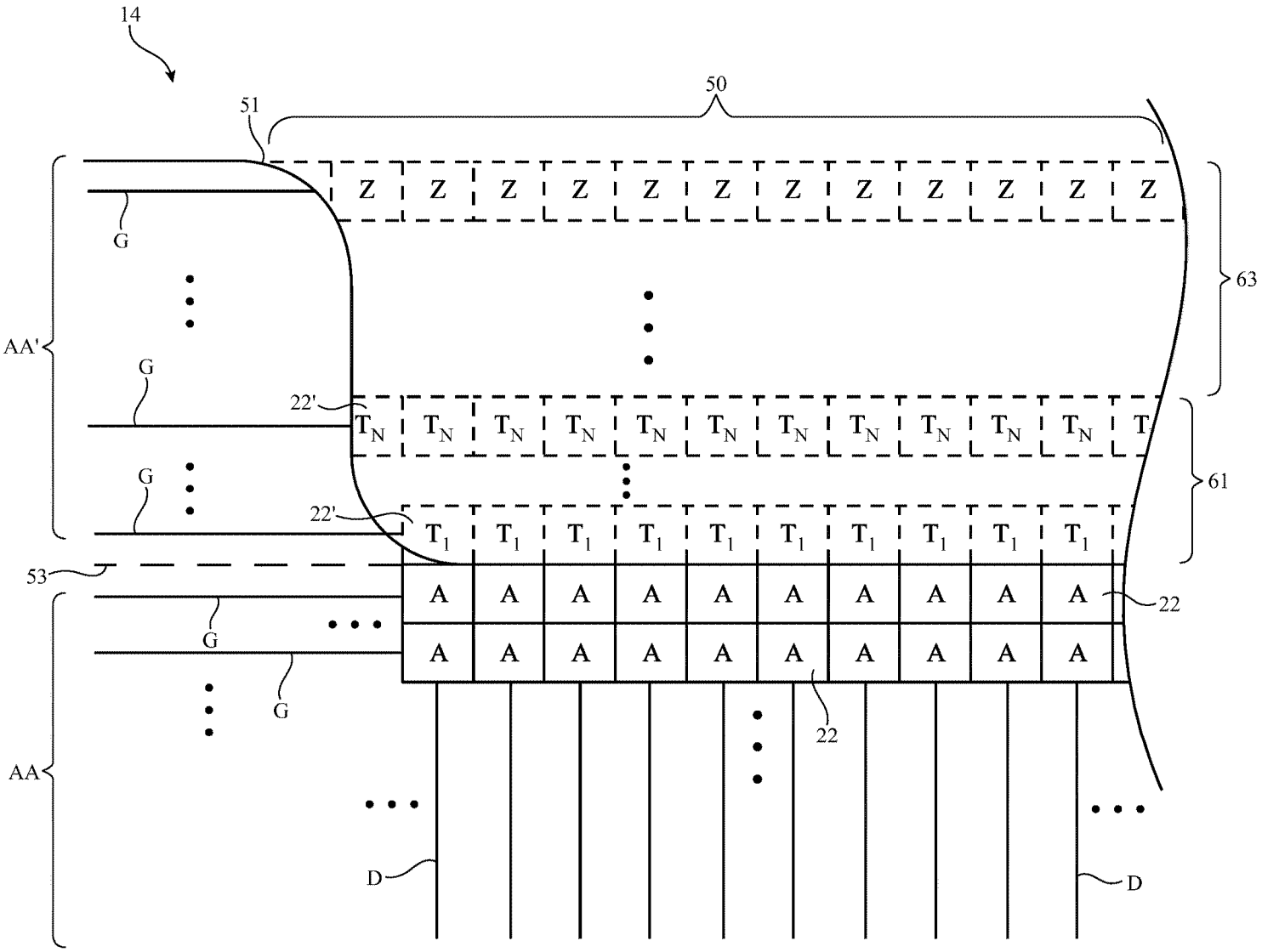
FIG. 4 is a diagram of a portion of an illustrative organic light-emitting diode display having an inactive notch that extends into the active area in accordance with an embodiment.

An illustrative diagram of a portion of display 14 in the vicinity of notch 50 is shown in FIG. 4. FIG. 4 shows a group of display pixels 22 in active area AA beneath notch 50 that are provided with data signals (gray levels) of an exemplary value "A." Inactive notch 50 may include a transition region 61 (sometimes referred to herein as a border region) and an upper region 63 (sometimes referred to herein as a central region). Transition region 61 and upper region 63 correspond to virtual pixels 22' for which data lines D still carry data signals, although there are not actually light-emitting pixels in this area. In transition area 61, the data signals (gray levels) that are provided on data lines D for these imaginary pixels 22' are shown to have an exemplary value of "$T_1$" for the bottommost row of virtual pixels 22' in notch 50 (i.e., the last row of virtual pixels 22' before active area AA), and an exemplary value of "$T_N$" for a row of virtual pixels in transition region 61 that is farther from notch-active area border (e.g., the last row of pixels in transition area 61). Transition region 61 may correspond to (include) two, three, five, ten, twenty-five, fifty, one hundred, or other numbers of rows of virtual pixels 22' (e.g., the value of N in $T_N$ may be between 2 and 500, inclusive). The data signals (gray levels) that are provided on data lines D for imaginary pixels 22' in upper portion 63 are shown to have an exemplary value of "Z." Upper region 63 may correspond to (include) two, three, five, ten, twenty-five, fifty, one hundred, or other numbers of rows of virtual pixels 22'.

In one illustrative example, the values of inactive data signals corresponding to transition area 61 may gradually decrease for rows of virtual pixels 22' that are farther from the border between the inactive notch and the active area. For example, the gray level value A for display pixels 22 in active area AA may be 150. Rather than adjusting the gray level values for all virtual pixels 22' to zero (which may cause undesirable display artifacts), the gray level $T_1$ for a first row of virtual pixels 22' in transition area 61 may be set to 100. The gray level $T_N$ for the last row of virtual pixels may be set to 1. The gray levels for the virtual pixels 22' between the first and last rows of virtual pixels in transition zone 61 may have values between 1 and 100. In this way, null data corresponding to the inactive notch (e.g., transition zone 61) may be referred to as gray data or gray image data that includes a plurality of different gray levels. The gray levels may decrease linearly or exponentially the farther into transition zone 61 the virtual pixel is. In other words, gray levels (data signals) corresponding to the inactive notch may decrease linearly or exponentially with increasing distance from the active area-inactive notch border (e.g., the farther from the inactive notch-active area border the location in transition zone 61 to which the null data signal corresponds is, the lower the gray level may be). The gray level Z for virtual pixels 22' in upper zone 63 may be set to zero. In this way, null data corresponding to the inactive notch (e.g., upper zone 63) may be referred to as black data. By gradually reducing (tapering) the gray levels provided on data lines D that terminate at notch 50, the voltage drop on the positive power supply line may be limited and the presence of the dim line around the border 53 may be reduced or eliminated. Because the inactive data signals provided on data lines D are still taken to zero for some of the virtual pixels 22', and because the inactive data signals that are higher than zero are still reduced relative to the data signals that are being provided to display pixels 22 in active area AA, the impact of these inactive data signals on pixel luminance degradation tracking may be limited such that premature display dimming is minimized.

Because transition region 61 and upper region 63 of notch 50 correspond to rows of pixels into which notch 50 extends, the null data corresponding to the values of Z, $T_1$, $T_N$, and/or the other gray values for transition region 61 may be provided when the gate lines for these rows are being used control data loading. For example, while using a first gate line(s) corresponding to a row(s) of pixels into which notch 50 extends, display driver circuitry 20 may provide a data line(s) D that truncates at notch 50 with null data signals corresponding to gray values of $T_1$, $T_N$, and/or the other gray values (e.g., gray data) for transition region 61. There may be one, two, three, four, five, ten, or more gate lines for which display driver circuitry 20 operates in this manner to provide gray data. The gray levels associated with the gray data may decrease linearly or exponentially with increasing distance (of the gate line) from the border between inactive notch 50 and the active area AA. While using a second gate line(s) corresponding to a second row(s) of pixels into which notch 50 extends, display driver circuitry 20 may provide the data line(s) D that truncates at notch 50 with null data signals corresponding to gray values of Z (e.g., black data). There may be one, two, three, four, five, ten, or more gate lines for which display driver circuitry 20 operates in this manner to provide black data.

The example described above is merely illustrative. If desired, the gray levels for virtual pixels 22' may be determined in other ways. For example, the gray levels for virtual pixels 22' may decrease with distance from border 51 according to functions other than linear or exponential functions, may be adjusted using fixed or dynamically determined offset values, may be adjusted from a value of 0 (or other value) as previously determined by data signal attenuation operations, may be adjusted from an original gray level that was not determined by data signal attenuation operations, or may be determined in other ways. If desired, the values of Z, $T_1$, $T_N$, and/or the other gray values for transition region 61 may all be the same. For example, all of the virtual pixels 22' may be provided with the same gray level (e.g., a gray level between 0 and 255). In another illustrative arrangement, the values of Z, $T_1$, $T_N$, and/or the other gray values for transition region 61 may be random gray levels, some or all of which are between 0 and 255. The values of gray levels for display pixels 22 and virtual pixels 22' provided above are also merely illustrative. The gray levels provided to display pixels in active area AA may vary based on the frame of image data behind displayed on display 14. The adjusted gray levels provided on data lines D for virtual pixels 22' may vary based on the gray levels of pixels 22 near notch 50 and based on the function or other method used for determining the adjusted gray levels. Gray levels for virtual pixels 22' may be static (e.g., may be predetermined and held constant between multiple frames of display data) or may be dynamic (e.g., changing between frames of display data and determined based on the data provided to pixels 22 in active area AA, if desired).

In arrangements in which gray values for virtual pixels 22' are predetermined or random gray values (as opposed to being gradually reduced to zero as a function of distance from the border 51), the gray values may be selected so as to minimize the impact of these inactive data signals on pixel luminance degradation tracking and limit premature display dimming. For example, the pixel luminance degradation compensator may not take into account (i.e., may be insensitive to) gray levels that are below a threshold value when tracking pixel luminance degradation. In one illustrative example, this threshold value may be a gray level of 50. Setting the gray levels for virtual pixels 22' below this threshold may not affect pixel luminance degradation tracking (e.g., pixel luminance degradation tracking can be effectively bypassed for inactive data signals provided on data lines D that are not actually provided to pixels 22) while still easing the gray level transition at border 51.

Although data signal compensation operations are described above in connection with notch 50 in FIG. 4, the same or similar data compensation operations may be performed for inactive data signals that are provided for virtual pixels 22' in corner regions 59.

Figure 5:
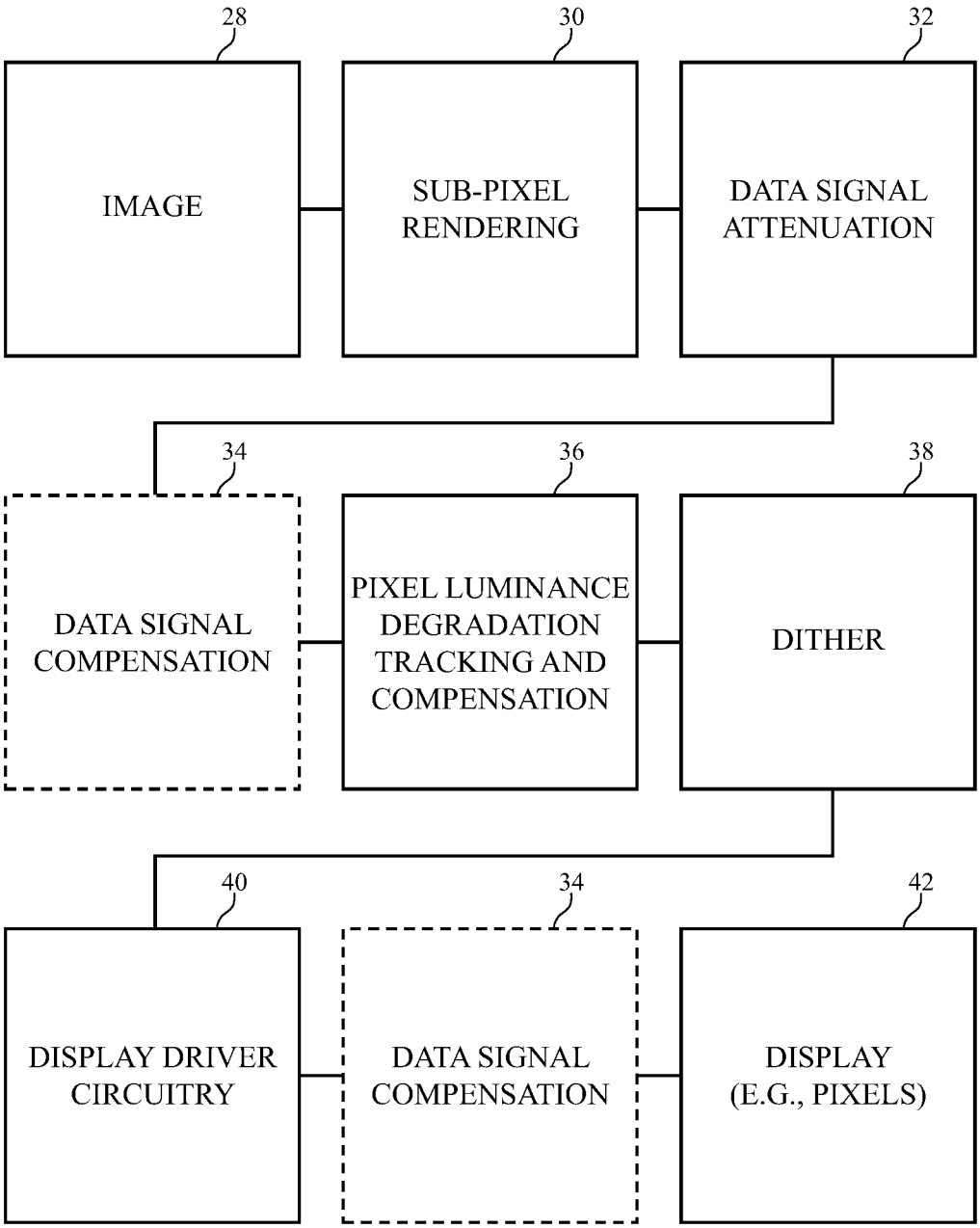
FIG. 5 is a diagram of an illustrative pipeline for displaying images on a display in accordance with an embodiment.

A diagram of an illustrative pipeline for displaying an image on display 14 using gray level compensation of the type described above in connection with FIG. 4 is shown in FIG. 5. As shown in block 28, the display pipeline may begin with a frame of image data. In one illustrative example, the frame of image data is provided by control circuitry 16 of device 10. At block 30, sub-pixel rendering may process (e.g., using a sub-pixel rendering engine) the frame of image data to produce data signals corresponding to the specific arrangement of red, green, and blue sub-pixels used in display 14. At block 32, data signal attenuation may be performed. At block 36, pixel luminance degradation tracking and compensation may be performed. At block 38, dithering operations may be performed (e.g., using a dithering engine) on the data signals. Dithering operations may adjust gray levels such that the average gray level for a group of pixels is equal to the desired gray level for all of the pixels in the group, even though none of the individual pixels in the group may be programmed with the desired gray level. Dithering operations may be used to smooth the visual appearance of the border between notch 50 and active area AA. At block 40, the data signals may be provided to display driver circuitry 20. At block 42, display driver circuitry 20 may drive the data signals onto data lines D in display 14 to display the frame of image data.

At block 34, data signal compensation operations of the type described above in connection with FIG. 4 may be performed. In one illustrative example, data signal compensation operations may be performed before pixel luminance degradation tracking and compensation are performed at block 36 (e.g., between blocks 32 and 34). In an arrangement such as this, the data signals are adjusted to be low enough so as to not affect pixel luminance degradation tracking or cause premature display dimming, while still easing the gray level transition between the active area and the inactive notch.

In another illustrative arrangement, data signal compensation operations at block 34 may not be performed until after pixel luminance degradation tracking and compensation are performed at block 36. In this type of arrangement, the gray levels for virtual pixels 22' are still adjusted to a low value (e.g., a gray level between 0 and 10, inclusive) using data signal attenuation operations before pixel luminance degradation tracking and compensation are performed at block 36 so that the effects of these inactive data signals on pixel luminance degradation tracking are minimized. In order to make the gray level transition between the active area and the inactive area more gradual, however, the inactive data signals can be adjusted again before being driven onto data lines D. In one arrangement, data signal compensation operations in block 40 may include applying an offset to the gray values (e.g., adding to the gray value) as reduced by the data signal attenuation and applying a gain to the gray levels as reduced by the data signal attenuation (and/or as adjusted by the offset). The combination of the offset and the gain may adjust all of the inactive data signals for virtual pixels 22' to an arbitrary gain level (e.g., 255) that reduces or eliminates the presence of undesirable display artifacts such as dim lines near notch 50.

In another illustrative arrangement, data signal compensation operations in block 34 may include applying a gain to the gray levels that have been reduced by the data signal attenuation operations without applying an offset. In such an arrangement, the inactive data signals may have been adjusted by the data signal attenuation operations to a value greater than 0 (e.g., between 1 and 10). The gain may adjust all of the inactive data signals for virtual pixels 22' to an arbitrary gain level (e.g., 255) that reduces or eliminates the presence of undesirable display artifacts such as dim lines near notch 50.

When performed after pixel luminance degradation tracking and compensation operations of block 36, data signal compensation operations may be performed in display driver circuitry 20. If desired, data signal compensation may be performed at the same time as other pixel compensation operations that occur in display driver circuitry 20. In another example, data signal compensation operations may be performed between the time at which the data signals are transmitted from display driver circuitry 20 in block 36 and when they are displayed on display 14 in block 38.

In another example, display driver circuitry 20 may be configured to not provide data signals to the data lines D that terminate under notch 50 when the display rows that are being programmed do not include pixels that receive data signals from those data lines D (i.e., rows of the display into which notch 50 extends). In other words, display driver circuitry 20 may temporarily suspend data line toggling when the data signals would not actually be provided to display pixels 22 (and instead correspond to virtual pixels 22'). In this arrangement, there would be no data signals being provided for virtual pixels 22' to affect pixel luminance degradation tracking compensation or to create a sudden gray level transition, helping to minimize both premature display dimming and undesirable display artifacts at the active area-inactive area border 51. Because display driver circuitry 20 suspends data signal writing operations for a period of time, operating display 14 in this manner may also help to conserve power.

Figure 6:
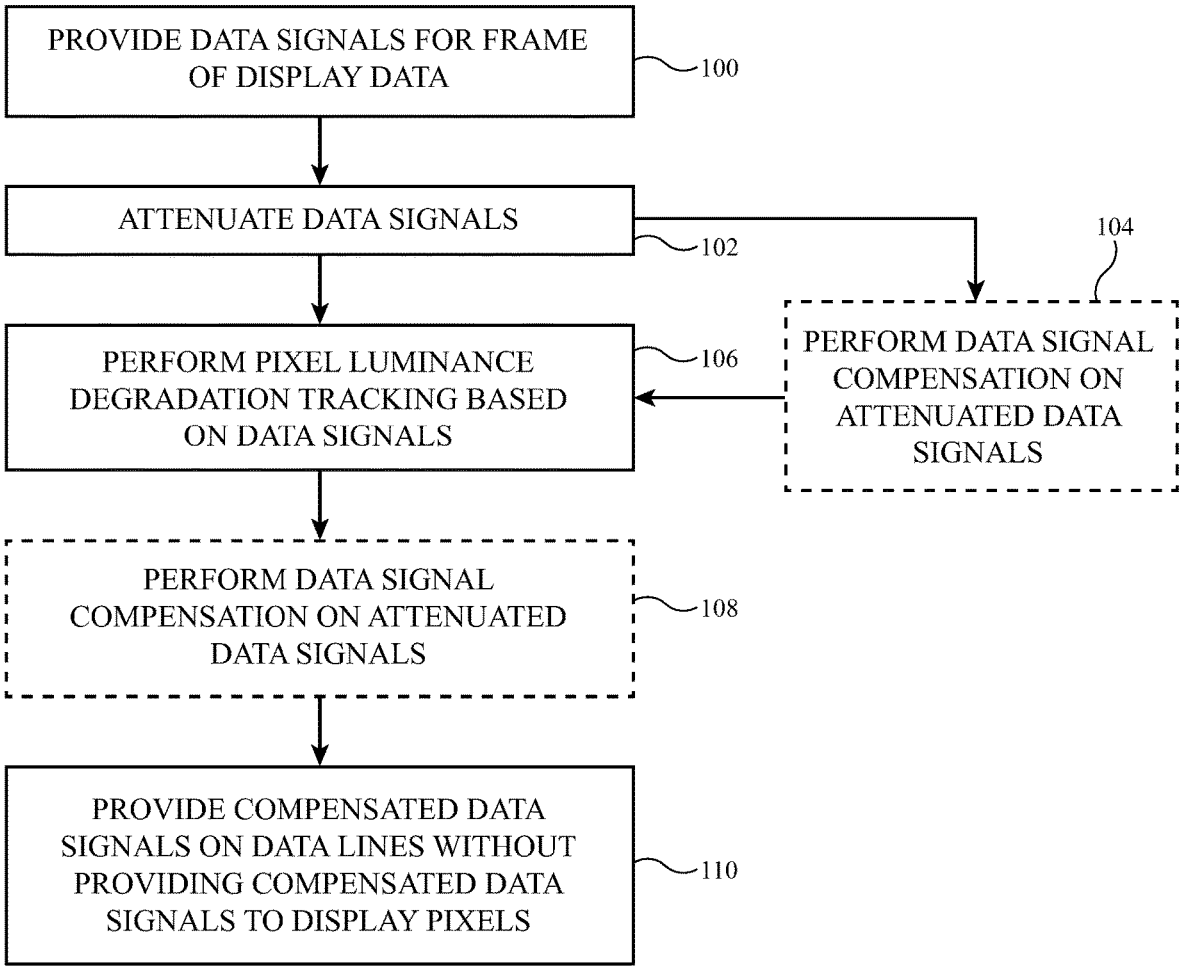
FIG. 6 is a flow chart of illustrative steps involved in adjusting display signals in a display in accordance with an embodiment.

An illustrative flow chart of steps that may be taken in a method of adjusting display signals corresponding to notch 50 is shown in FIG. 6.

At step 100, control circuitry 16 may provide a frame of display data to be displayed on display 14.

At step 102, data signal attenuator 55 may attenuate (convert to black data) the inactive data signals (e.g., data signals corresponding to virtual pixels 22') in the frame to minimize the effect of the data signals on pixel luminance degradation tracking.

At optional step 104, data signal compensator 57 may adjust (convert to gray data) the attenuated data signals to ease the transition between the data signals that are provided to the pixels in the active area AA of display 14 and the inactive data signals for virtual pixels. If optional step 104 is performed, optional step 108 may be skipped and step 106 may proceed directly to step 110.

At step 106, the data signals may be tracked using pixel luminance and degradation compensation to monitor the aging of pixels in display 14.

At optional step 108, data signal compensator 57 may adjust the attenuated data signals to ease the transition between the data signals that are provided to the pixels in the active area AA of display 14 and the inactive data signals for virtual pixels. If optional step 108 is performed, optional step 104 may be skipped and step 102 may proceed directly to step 106.

At step 110, the compensated data signals may be conveyed on data lines D without actually being provided to pixels 22 in the active area of the display.

The foregoing is merely illustrative and modifications can be made to the described embodiments. The foregoing embodiments may be implemented individually or in any combination.

What is claimed is:

1. A display, comprising:

display pixels that form an active area;

an inactive region that extends at least partially into the active area; and display driver circuitry configured to provide image data to the display pixels in the active area, to provide black data corresponding to a first portion of the inactive region, and to provide gray data corresponding to a second portion of the inactive region different than the first portion.

2. The display of claim 1, wherein the first portion comprises a first row, and wherein the second portion comprises a second row.

3. The display of claim 1, wherein the inactive region comprises a notch-shaped recess.

4. The display of claim 1, wherein the inactive region comprises a notch.

5. The display of claim 1, wherein the inactive region protrudes into the active area.

6. The display of claim 1, further comprising:

a transition region formed in the inactive region, wherein the display driver circuitry is further configured to provide gradually decreasing gray values corresponding to the transition region.

7. The display of claim 6, wherein the black data corresponds to an edge of the transition region.

8. The display of claim 1, wherein the inactive region is configured to accommodate a component selected from the group consisting of: a speaker, a camera, an ambient light sensor, and a proximity sensor.

9. A display, comprising:

display pixels forming an active area;

an inactive region in the active area;

a pixel luminance degradation compensation circuit configured to reduce a brightness of the display based on pixel aging information; and display driver circuitry configured to provide active data signal to the display pixels and inactive data signals corresponding to the inactive region, wherein the inactive data signals are attenuated to prevent the pixel luminance degradation compensation circuit from reducing the brightness of the display based on the pixel aging information corresponding to the inactive region.

10. The display of claim 9, wherein the inactive data signals are adaptively adjusted to provide a smooth visual transition between the active area and the inactive region.

11. The display of claim 9, wherein the attenuated inactive data signals comprise black data signals.

12. The display of claim 11, wherein the attenuated inactive data signals further comprise gray data signals.

13. The display of claim 9, wherein the attenuated inactive data signals comprise gray data signals.

14. The display of claim 13, wherein the attenuated inactive data signals comprise gray data signals with a plurality of different gray values.

15. The display of claim 14, wherein the plurality of different gray values comprises linearly decreasing gray values.

16. The display of claim 14, wherein the plurality of different gray values comprises exponentially decreasing gray values.

17. A display, comprising:

display pixels forming an active area;

an inactive region in the active area that is at least partially surrounded by the display pixels from at least three sides; and display driver circuitry configured to provide active data signals to the display pixels and to provide inactive data signals corresponding to at least two adjacent rows in the inactive region.

18. The display of claim 17, wherein the inactive data signals comprises only black and gray data signals.

19. The display of claim 17, wherein the inactive data signals are generated from the active data signals.

20. The display of claim 17, wherein the inactive region is configured to accommodate an optical sensor.

* * * * *